US005762562A

United States Patent [19]

Tiedge

[11] Patent Number: 5,762,562

[45] Date of Patent: Jun. 9, 1998

[54] GOLF PRACTICE DEVICE

[75] Inventor: Till Tiedge, Wittelsbacher Weg 5, D-87645 Schwangau, Germany

[73] Assignees: Dietor Hoch, Headingly, Canada; Josef Kopf, Schwangau, Germany; Bernhard Kopf, Schwangau, Germany; Till Tiedge, Schwangau, Germany

[21] Appl. No.: 774,042

[22] Filed: Dec. 27, 1996

[30] Foreign Application Priority Data

Jan. 9, 1996 [DE] Germany ..... 196 00 517.5

[51] Int. Cl.[6] ..... A63B 69/36

[52] U.S. Cl. ..... 473/143; 473/145; 473/146

[58] Field of Search ..... 473/139, 144, 473/147, 143, 145, 146

[56] References Cited

U.S. PATENT DOCUMENTS 1,258,241 3/1918 Porte ..... 473/139

1,907,412 5/1933 Zimmer ..... 473/144

4,986,551 1/1991 Langlois ..... 473/147

*Primary Examiner*—George J. Marlo

*Attorney, Agent, or Firm*—Notaro & Michalos PC

[57] ABSTRACT

A golf practice device has an angled, curved or straight frame made of tubular steel on which two anchor points are formed between which a rope is tensioned. A golf-ball-like body is tracked along the rope by means of a flexible connector. A strike plate is located on the rope in the vicinity of an upper anchor point. The frame and the rope form a closed tensioning system which generates vibrations in the rope when the body hits the strike plate, where the magnitude and direction of the amplitudes of said vibrations are a function of the point of contact between the body and the strike plate. The vibrations of the rope affect the type of movement of the struck body during its return to the first anchor point such that the user can draw conclusions about the nature of his golf swing.

10 Claims, 2 Drawing Sheets

11
20
24
26
28
32
34
36
38
40
42
44
46
47
48
50
52
54

GOLF PRACTICE DEVICE

The current invention relates to a golf practice device incorporating a tracking system that is tensioned in a straight line between a first anchor point close to the ground and a second anchor point at a certain distance in a horizontal plane and at a higher level, furthermore incorporating a golf-ball-like body which is tracked along the tracking system by means of a connector and also a strike plate which is located in the vicinity of the second anchor point at least approximately perpendicular to the tracking system.

Golf practice devices of this type are known from U.S. Pat. No. 1,907,412 and U.S. Pat. No. 1,258,241. The two anchor points are each supported on the ground independently of each other. At least the first anchor point close to the ground is formed by a ground anchor set into the ground. If the golf-ball-like body hits the strike plate at a speed of approx. 200 km/h, the kinetic energy must be abruptly dissipated as destruction of the plate or its connector will otherwise occur. The devices known in the art use damping devices to this end which, however, act as a spring energy store which expands in the opposite direction after compression and greatly accelerates the golf ball downwards towards the first anchor point. Apart from the accident risk, these devices permit no conclusions to be drawn on the position of the point of contact of the golf ball on the strike plate.

It is the object of the invention to improve the golf practice device known in the art such that the dissipation of the striking golf ball's kinetic energy occurs differently as a function of the point of contact on the strike plate such that the subsequent downward movement of the golf ball permits conclusions to be drawn about the point of contact on the strike plate and/or the contact speed.

This object is achieved in a golf practice device of the type mentioned in the introduction in that the two anchor points are connected to each other by a free-standing, dimensionally-stable frame such that the frame and the tracking system form a closed tensioning system.

The invention provides for a closed energy absorption system which is independent of the ground and in which the force of the struck body results in elastic deformation of the frame. This deformation causes the tracking system to vibrate with amplitudes which are perpendicular to the longitudinal axis. The magnitude of the amplitudes is a function of the centre distance from the point of contact and of the contact speed. If, for example, the body hits the right side of the strike plate, the vibrating tracking system exerts a rotary force on the body via its connector such that the body rotates clockwise about the tracking system. A substantial proportion of the kinetic energy is dissipated through this circular motion of the body. The body moves downwards in an approximately helical path until sufficient rotary force has dissipated to allow it to slide down to the first anchor point. The strike force is also indicated by the golf practice device in accordance with the invention. If, namely, the ball hits the centre of the strike plate with excessive force, the tracking system begins to vibrate with a large amplitude on both sides of the longitudinal axis of the tracking system. These vibrations hold the body or its connector in the region of the strike plate such that it can only slide downwards towards the first anchor point once the vibrations have ceased. If, on the other hand, the body is hit with appropriate force against the centre of the strike plate, the vibration pattern of the system is also symmetrical to the tracking system's longitudinal axis but the amplitudes of the vibrations are so small that the connector is not braked and the body therefore returns almost without delay to the first anchor point. This vibrational behaviour is caused by the closed tensioning system.

In one embodiment of the invention the frame comprises a ground rod and an upright rod and two lateral supporting feet engaging in the area of the connection point of the two rods, with one of the two anchor points being formed at the free end of each rod. This frame therefore has three points of contact with the ground, namely in the region of the free end of the ground rod and at the two support feet.

An alternative solution for the frame consists therein that this is formed by a single projecting rod, one end of which is mounted on a support foot with ground arms, where the rod reaches upwards in a diagonal or curved line and forms the second anchor point at its free end. Where this line is straight the rod has a kink or bend at least in the region of its second anchor point so that the tracking system can be tensioned at a distance from the rod.

The invention is described in greater detail with reference to the embodiments illustrated in the drawing.

Figures 1, 1A:
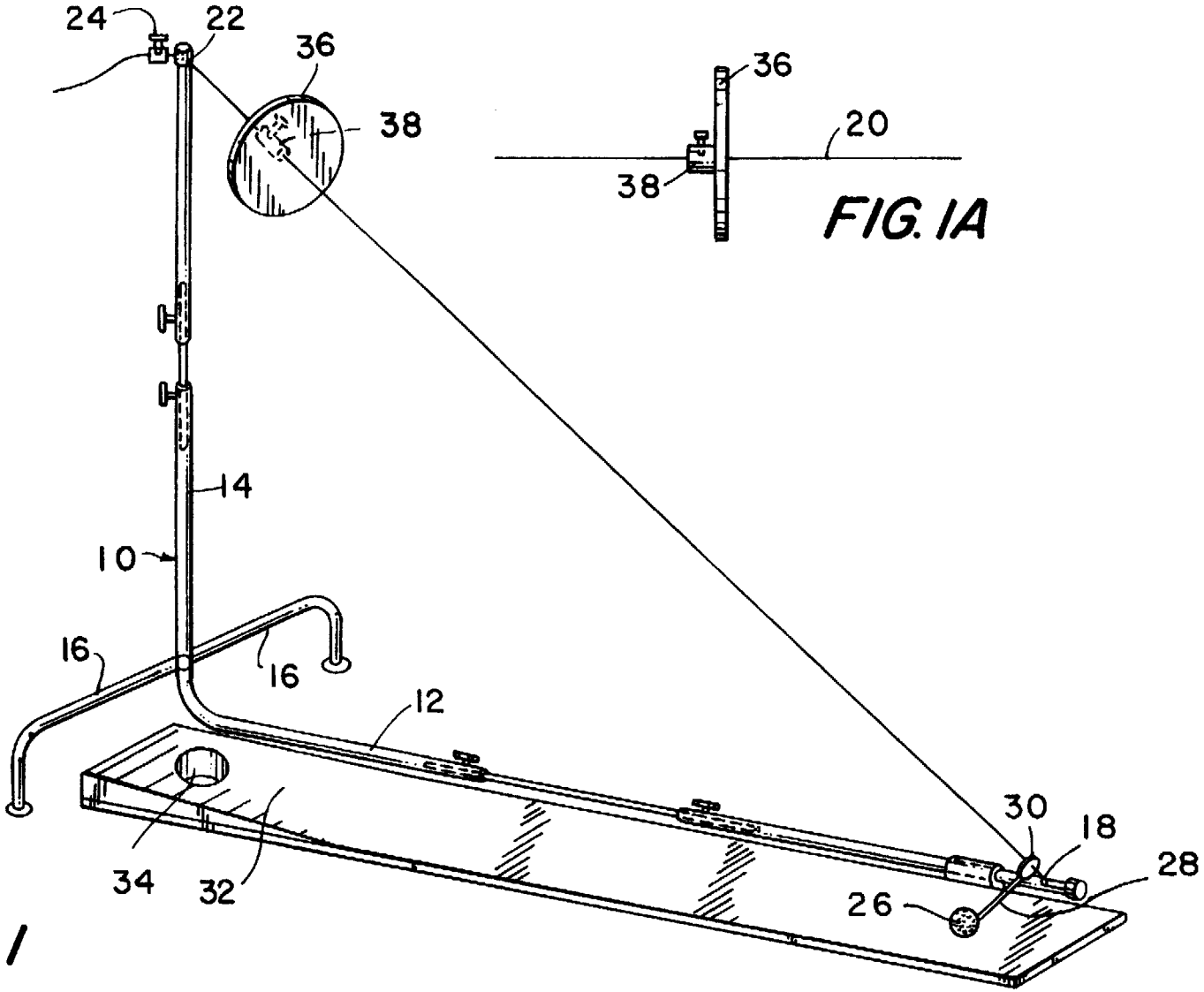
FIG. 1 shows a view of a first embodiment of a golf practice device with an enlarged detail view of the attachment of a strike plate to a rope.
FIG. 1A shows an enlarged detail view of a rope clamp fitted on a strike plate.

An L-shaped frame 10 consists of a ground rod 12 and an upright rod 14, both of which consist of telescopic tubes which can be extended to different lengths. Laterally-projecting support feet 16 are provided in the region of the connection point of the two arms 12, 14. The free end of the ground arm 12 lies in contact with the ground. A first anchor point 18 is formed at this end for a rope 20 which leads to the free end of the upright arm 14 where the second anchor point 22 is located. The rope 20 passes through a hole in the upper end of the upright arm 14 and a rope clamp 24 by means of which the rope 20 can be tensioned. A golf-ball-like body 26 is tracked along the rope 20 by means of a connector 28 which has a ring or a loop 30, through which the rope 20 passes. Next to the ground arm 12 is a mat 32 which lies on the ground, extends the full length of the ground arm and is sufficiently thick in the vicinity of the support feet 16 as to create a hole 34 of sufficient depth. This mat is used to practise putting.

A strike plate 36 which has circular contours and through the centre of which the rope 20 passes is attached to the rope 20 a short distance from the upper second anchor point 22. A clamp device 38 by means of which the strike plate is anchored on the rope is located on the rear of the strike plate 36.

When putting on the mat 32 a standard golf ball which is independent of the device is used. However, the body 26 shown in the drawings which can also consist of a golf ball is permanently connected to the rope 20 by means of the connector 28, e.g. a thin flexible rope or spring wire. If this body 26 is now hit against the strike plate 36, the upright rod 14 is displaced because of a momentary extension of the rope 20, as a result of which the rope 20 is greatly tensioned and forces the floor rod 12 to become deformed which in turn causes relaxation of the rope 20. When the arms spring back, the tension/relaxation interaction of the rope 20 is repeated. As a result of the amplitudes of the rope vibrations the centrifugal forces of the body 26 which is connected to the rope via the connector 28 are dissipated, so that the body 26 can slide back to the anchor point 18 on the rope 20 which is gradually returning to its position at rest.

The device also makes it possible to identify where the body 26 would have travelled and how accurately the stroke was executed. If, for example, the body 26 hits the right side of the strike plate 36, the right side of the strike plate is displaced further than the left side, and when the frame springs back lateral relaxation waves occur in the rope 20 which result in the body 26 beginning to rotate clockwise about the rope 20. This type of golf stroke is termed a slice. If the body 26 hits the left side of the strike plate 36, the body 26 is subjected to an anti-clockwise rotary force. This is known as a hook shot.

If excessive back spin is put on the body 26 during the stroke, the impact force is insufficient for the body to reach the strike plate 36. The braking effect on the rope is then too strong. If, on the other hand, the ball is played with too much force directly onto the centre of the strike plate 36, the relaxation wave that occurs from the top to the bottom causes very marked braking of the body. It therefore returns more slowly to the anchor point 18 than would be the case with a good, lightly and smoothly executed golf swing. In a perfect golf swing the body 26 hits the strike plate 36 close to its centre. The rope begins to oscillate only with very small amplitudes, as a result of which the braking effect of the connector 28 remains small and the body 26 consequently performs no circular movements and returns to the point from which it was hit with minimal delay.

The strike plate 36 can be clamped at any desired point along the rope so that very gentle golf shots known as chips can also be practised.

Attention must finally also be drawn to the fact that the strike plate 36 consists of a disc-shaped hollow body which generates a note when the body 26, after being struck, hits the plate. The height of the note varies with the distance between the point of contact and the centre. The deepest note is caused when the point of contact of the body 26 is close to the centre.

In the embodiment in accordance with FIG. 1 the ground rod 12 has a length of 3.60 m and the upright rod 14 has a height of approx. 1.60 m. The two support feet 16 are approx. 0.65 m long.

Figures 2, 2A, 3:
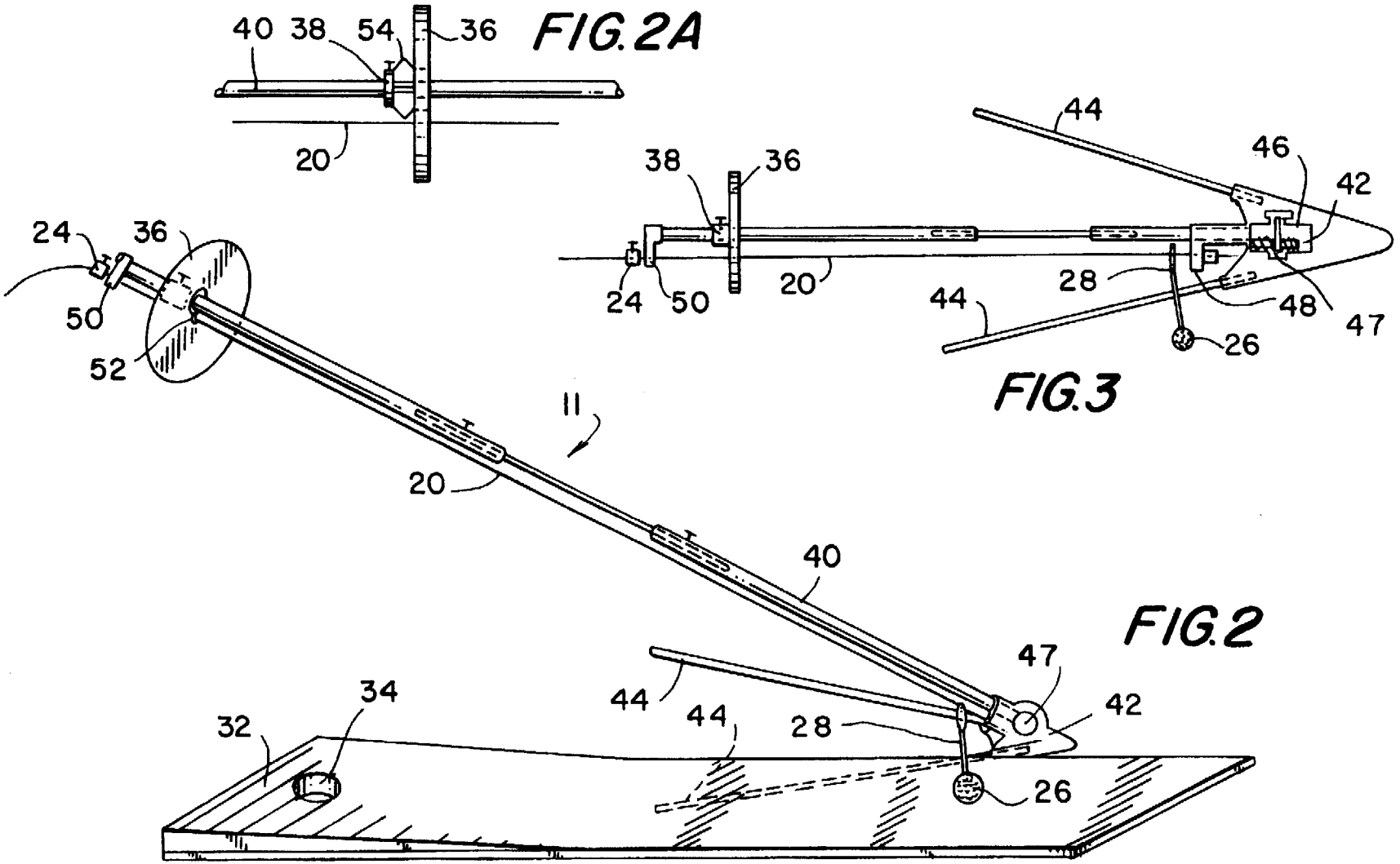
FIG. 2 shows a view of a modified embodiment of a golf practice device.
FIG. 2A shows a modification of the connection of a strike plate with a rope clamp by means of a spring device and FIG. 3 shows a plan of the practice device in accordance with FIG. 2 at a smaller scale.

The golf practice device in accordance with FIGS. 2 and 3 has a frame 11 in the form of a straight rod 40 whose lower end is mounted in a support foot into which two ground arms 44 in a V-shaped configuration and in the same plane are inserted. The support foot 42 comprises a retaining disc 46 which is bearing-mounted such that it can swivel about a horizontal shaft 47 and can be clamped either infinitely or finely adjustably in various pivot positions. This retaining disc 46 contains a channel to permit insertion of the rod 40. The angle of incline of the rod 40 and therefore the elevation of the strike plate 36 located on the rod 40 are therefore adjustable. A lateral bracket 48 which forms the first anchor point for a rope 20 is located at the front end of the retaining disc 46 of the support foot 42. A corresponding bracket 50 is located on the upper end of the rod 40. The rope 20 is tensioned between its two anchor points by means of the rope clamp 24 already described. Here too a closed tensioning system is created. The brackets 48, 50 are shown to be extremely short in this embodiment so that the rope 20 is very close to and parallel to the rod 40.

In an advantageous modification (not shown) the brackets 48, 50 are longer than shown in FIG. 2 so that the distance between the rope 20 and the rod 40, at least in the region in front of the strike plate 36, is at least equal to the length of the connector 28 plus the diameter of the body 26 so that the body 26 can rotate freely about the rope 20.

The rod 40 must also not necessarily be straight. A rod composed of a plurality of bent tube sections is even advantageous in order to increase the amplitudes of the oscillation pattern of the rope 20. The rod 40 and the rope 20 then form a bow as used in archery. However, the curvature of the bow should not be uniform; rather it should be at its greatest in the vicinity of the strike plate, i.e. near the upper end of the rod, and can then decrease gradually towards the support foot 42 or even run in a straight line. The rope 20 then forms an acute angle with at least the lower half of the rod 40.

In the embodiment in accordance with FIGS. 2 and 3 the strike plate 36 is clamped with the rear clamp device 38 on the rod 40. The rope 20 passes through a hole 52 in the strike plate 36. The rod 40 must have a high degree of elastic flexibility in order to achieve an adequate oscillation pattern when a body 26 hits the strike plate 36.

In an advantageous modification of FIG. 2 a strike plate 36 with a rear rope clamp 38 as in FIG. 1 is used where the rod 40 passes through the strike plate 36 with sufficient radial clearance. If the rod 40 is sufficiently far from the rope 20 in the area of the strike plate as a result of appropriate rod curvature, the rod does not pass through the strike plate 36 but passes it by at a distance.

The rope clamp 38 is preferably connected to the strike plate 36 by spring means 54 (FIG. 2A) which permit the strike plate 36 to be inclined in all directions towards the direction of axis of the rope clamp 38.

I claim:

1. A golf practice device comprising:

a free-standing support;

a guiding memeber tensioned in a straight line between a first anchor point provided on the support close to the ground and a second anchor point provided on the support at a horizontal distance from the first anchor point, the guiding member and support forming a closed tensioning figure;

a golf-ball-like body tracked along the guiding member by a connector;

a strike plate attached to the tensioning figure near the second anchor point at least approximately perpendicular to the guiding member, wherein when the golf-ball-like body contacts the strike plate, the tensioning figure undergoes momentary displacements of both first and second anchor points.

2. A device as claimed in claim 1, wherein the support comprises a bottom rod, an upright rod connected to the bottom rod, and two lateral supporting feet engaging at least one of the bottom rod and the upright rod in an area where the rods are connected together, the first anchor point being located at the free end of the bottom rod, the second anchor point located at the free end of the upright rod.

3. A device as claimed in claim 1, wherein the free-standing support comprises a projecting rod, one end of which is mounted on a support foot having at least a pair of bottom arms, the projecting rod extending upwards from the support foot and having a free end forming the second anchor point, such that the first and second anchor points are the endpoints of an inclined line.

4. A device as claimed in claim 3, wherein the strike plate through which the projecting rod passes has a clamp device on its rear surface facing the second anchor point for connecting the strike plate to the projecting rod.

5. A device as claimed in claim 4, wherein the strike plate and the clamp device are connected by a spring device.

6. A device as claimed in claim 3, wherein the strike plate is clamped to the guiding member and maintained at a distance from the projecting rod, such that the strike plate is not in contact with the projecting rod.

7. A device as claimed in claim 6, wherein the projecting rod extends past the strike plate at a radial distance from the strike plate.

8. A device as claimed in claim 1, wherein the support has at least one rod composed of a plurality of telescoped tubes.

9. A device as claimed in claim 1, wherein the guiding member comprises a rope to which an adjustable rope clamp is provided at one of the first and second anchor points.

10. A device as claimed in claim 1, wherein the strike plate is provided on the guiding member such that its position is longitudinally adjustable.

* * * * *